US005595409A

United States Patent [19]

Fier et al.

[11] Patent Number: 5,595,409

[45] Date of Patent: Jan. 21, 1997

[54] GLIDING DOOR LATCH ASSEMBLY

[75] Inventors: Duane T. Fier, Hudson, Wis.; Scott J. Rote, Rockford, Ill.

[73] Assignee: Anderson Corporation, Bayport, Minn.

[21] Appl. No.: 270,496

[22] Filed: Jul. 5, 1994

[51] Int. Cl.[6] ..... E05C 5/00

[52] U.S. Cl. ..... 292/112; 292/341.13; 292/341.18; 292/DIG. 46

[58] Field of Search ..... 292/112, 114, 292/199, 341.13, 341.17, 341.18, 340, DIG. 46, DIG. 60

[56] References Cited

U.S. PATENT DOCUMENTS

| | | | |
|---|---|---|---|
| 1,083,438 | 1/1914 | Dohse | 292/112 |
| 1,111,425 | 9/1914 | Ziganet | 292/341.18 |
| 1,320,444 | 11/1919 | Buczynski et al. . | |
| 1,463,384 | 7/1923 | Butterworth | 292/341.18 |
| 1,596,242 | 8/1926 | Dunn | 292/112 |
| 2,668,071 | 2/1954 | Adams et al. | 292/129 |
| 2,701,156 | 2/1955 | Palmer, Jr. | 292/113 |
| 2,710,217 | 6/1955 | Curtiss | 292/341.18 |
| 2,789,852 | 4/1957 | Eads | 292/DIG. 46 |
| 2,928,689 | 3/1960 | Mineah | 292/DIG. 46 |
| 2,980,458 | 4/1961 | Russell | 292/DIG. 46 |
| 2,983,000 | 5/1961 | Metzger | 20/19 |
| 3,019,043 | 1/1962 | Woodworth | 292/DIG. 46 |
| 3,026,702 | 3/1962 | Cary | 70/97 |
| 3,048,435 | 8/1962 | De Marco | 292/111 |
| 3,105,711 | 10/1963 | Woodworth | 292/DIG. 46 |
| 3,117,811 | 1/1964 | Duvall | 292/DIG. 46 |
| 3,877,739 | 4/1975 | Cowen | 292/101 |
| 4,220,364 | 9/1980 | Poe | 292/341.18 |
| 4,434,635 | 3/1984 | Borgato | 70/279 |
| 4,475,313 | 10/1984 | Governale | 49/370 |
| 4,563,885 | 1/1986 | Madden | 70/97 |
| 4,796,932 | 1/1989 | Tame | 292/112 |
| 4,891,921 | 1/1990 | Governale | 52/207 |
| 4,915,428 | 4/1990 | Hayakawa | 292/29 |

FOREIGN PATENT DOCUMENTS

| | | | |
|---|---|---|---|
| 2076879 | 12/1981 | United Kingdom | 292/DIG. 46 |

*Primary Examiner*—Steven N. Meyers
*Assistant Examiner*—Gary Estremsky
*Attorney, Agent, or Firm*—Merchant, Gould, Smith, Edell, Welter & Schmidt, P.A.

[57] ABSTRACT

The present invention provides an assembly for latching a moving panel relative to a frame in which the moving panel slides or glides. A keeper is secured to the frame, and a latch is secured to the moving panel in such a manner that the keeper and latch are adjacent one another when the moving panel is moved to a closed position within the frame. Rotation of a key or handle on the moving panel causes the latch to extend and capture the keeper and pull the moving panel toward the frame as it latches. The latch cannot capture the keeper until a spike extending from the frame deflects a button on the moving panel. When the moving panel is latched, the spike provides resistance to vertical movement of the moving panel relative to the frame.

25 Claims, 7 Drawing Sheets

GLIDING DOOR LATCH ASSEMBLY

FIELD OF THE INVENTION

The present invention relates to latches and in particular, to an improved latch assembly for gliding doors and the like.

BACKGROUND OF THE INVENTION

Crime is a significant problem in the United States today, and public awareness of crime continues to rise. A natural reaction, which is evident in the marketplace, is that people are seeking additional security against crime, not only as a preventive measure but also simply for greater peace of mind. Accordingly, the degree of security associated with a given product is, now more than ever, a significant factor in the minds of the purchasing public. Obviously, the security factor is particularly acute in relation to the home.

People want to be safe and feel secure in their homes. However, the typical person does not want his or her home to look or feel like a fortress. A balance must be struck between safety and comfort, and convenience and cost must be taken into account, as well. The gliding glass door is a relatively popular home feature that exemplifies the kind of compromise between comfort and safety that people are willing to accept. The large expanse of glass "opens up" a room by allowing sunlight to enter and allowing occupants of the room to look outside, but the large expanse of glass also provides access to any criminal who would be willing to break the glass to enter through the door. In this regard, however, criminals typically prefer less conspicuous modes of entry, such as through an unlocked or easily jimmied door. Thus, most people would be comfortable with the security afforded by a gliding glass door so long as the door can be reliably and securely locked, and breaking the glass is the only way to gain unlawful entry.

An object of the present invention is to provide a gliding door latch that can move to a locked position only when the gliding door is properly located adjacent the door jamb, so that people cannot move the latch to a locked position without successfully latching the door and mistakenly believe the door to be latched when in fact it is not latched.

The "false latching" scenario discussed in the preceding paragraph may be caused by weather stripping disposed between the gliding door and the jamb. Typically, some amount of weather stripping must be compressed in order to provide an effective seal between the door and the jamb. Under such circumstances, an attempt to latch a Prior Art latching assembly may fail if the door is not pressed against the jamb with sufficient force to compress the weather stripping. Accordingly, another object of the present invention is to provide a gliding door latch that requires less force to close and successfully latch a gliding door, but that satisfactorily compresses weather stripping nonetheless.

Another object of the present invention is to provide a gliding door latch that provides significant resistance to vertical movement of the gliding door relative to the door frame, so that a criminal cannot simply rock or lift the door to overcome the latch.

Another object of the present invention is to provide a gliding door latch having greater structural integrity than Prior Art latching assemblies, so that a criminal cannot simply use force to overpower any of the latch components.

Another object of the present invention is to provide a gliding door latch that locks effectively and yet is also aesthetically pleasing.

Another object of the present invention is to provide a gliding door latch that is reliable and durable.

Another object of the present invention is to provide a gliding door latch that is easily installed and has interengaging components that are readily adjusted relative to one another.

Additional objects of the present invention will become apparent from the description that follows.

SUMMARY OF THE INVENTION

The present invention provides a lock or latch assembly for latching a movable panel in a closed position relative to a frame in which the movable panel glides or slides. The present invention is shown and described with reference to a preferred embodiment intended for use in connection with a gliding door unit of a type having at least one door that glides within a door frame. In this preferred embodiment, the latch assembly includes a latch portion secured substantially within a leading member on the gliding door, and a keeper portion secured substantially within a vertical jamb forming a part of the door frame.

A latch operator is located on either or both sides of the door and linked to the latch portion of the assembly. When the latch portion is proximate the keeper portion, manipulation of the latch operator causes a latch to project out from the latch portion and into engagement with the keeper portion. The latch engages a keeper on the keeper portion in a manner that pulls the latch portion toward the keeper portion and thereby effectively compresses any weather stripping between the leading member and the jamb, without requiring the person operating the latch to supply any significant force at any point during the latching operation. The keeper is pivotally secured to the keeper portion to allow adjustment of the gap between the leading member and the jamb when the two are latched relative to one another.

A face plate on the latch portion faces toward a strike plate on the keeper portion. A spike on the strike plate extends toward and is aligned relative to an opening through the face plate. The latch portion includes a button that is biased into the opening in the face plate and toward the strike plate. The latch cannot be moved to a keeper engaging or latched position until the spike deflects the button, thereby indicating that the leading member of the door is within working range of the jamb. Thus, the person operating the latch cannot move the latch operator to a latched position without effectively latching the door.

When the door is latched relative to the jamb, the spike projects through the face plate, thereby securing the door against vertical movement relative to the jamb. Also, the keeper is secured to a keeper lever at a location between a first end pivotally mounted to the keeper housing and a second end extending behind the strike plate, thereby effectively anchoring the keeper relative to the jamb. These advantages and others will become apparent upon a more detailed description of the invention.

BRIEF DESCRIPTION OF THE DRAWING

With reference to the Figures, wherein like numerals represent like parts and assemblies throughout the several views.

DETAILED DESCRIPTION OF A PREFERRED EMBODIMENT

Figure 1:
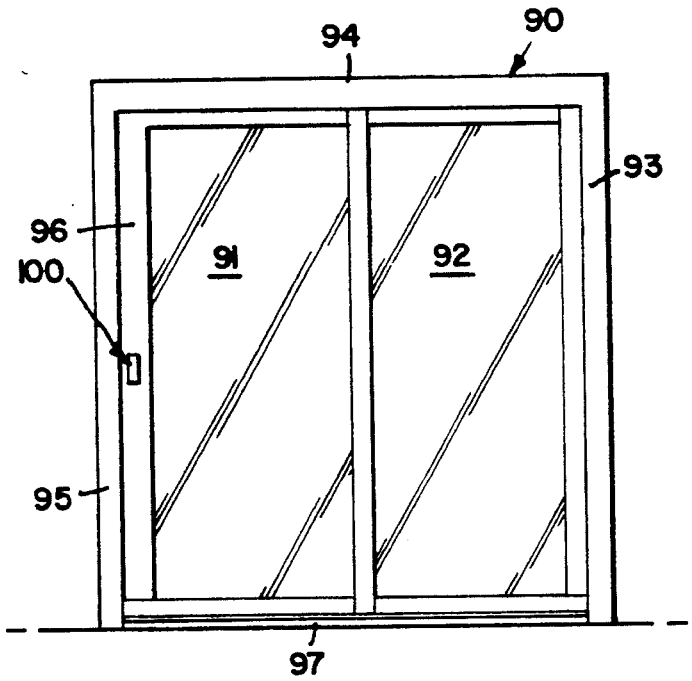
FIG. 1 is a front view of a gliding door unit to which is mounted a preferred embodiment latch assembly constructed according to principles of the present invention.
Figure 2:
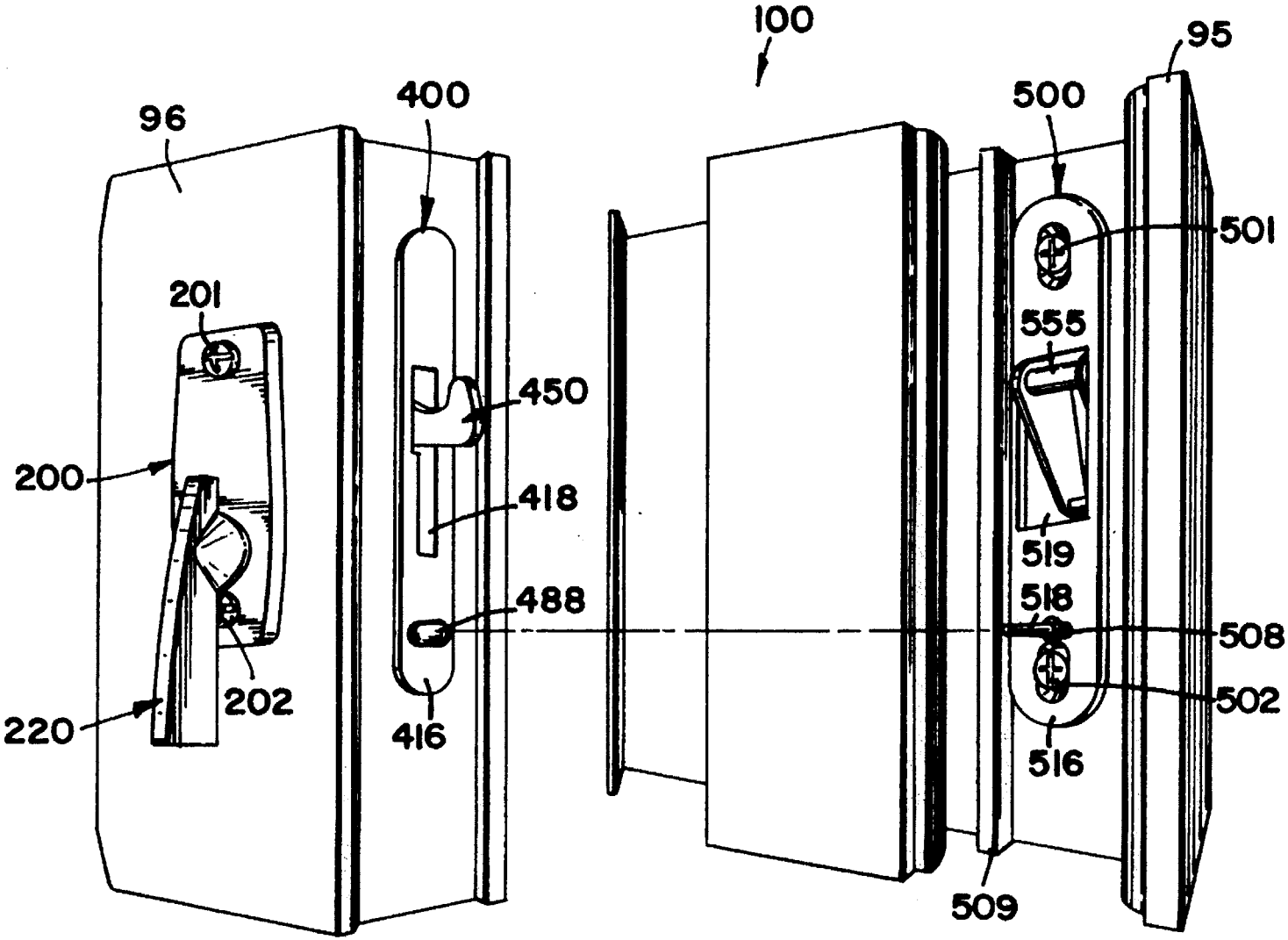
FIG. 2 is a perspective view of the preferred embodiment latch assembly shown in FIG. 1.
Figure 5:
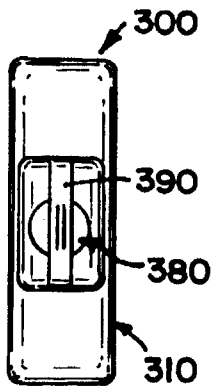
FIG. 5 is a front view of a key operator that is a component of the latch assembly shown in FIG. 2 (as viewed from outside the gliding door unit shown in FIG. 1)
Figure 6:
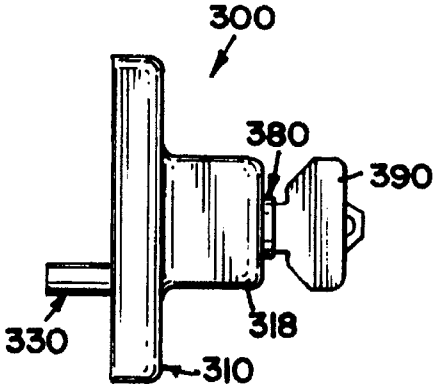
FIG. 6 is a side view of the key operator shown in FIG. 5.
Figure 7:
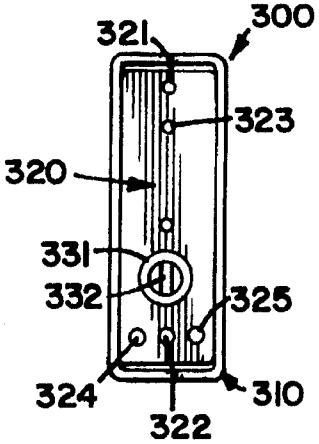
FIG. 7 is a rear view of the key operator shown in FIG. 5.

A lock or latch assembly constructed according to the principles of the present invention is designated as 100 in FIG. 2 and is shown in relation to a gliding door unit 90 in FIG. 1. The gliding door unit 90 includes a first door or panel 91 and a second door or panel 92 mounted within a door frame. The door frame includes a pair of parallel vertical jambs 93 and 95, a horizontal head jamb 94 extending between upper ends of the vertical jambs, and a horizontal sill jamb 97 extending between lower ends of the vertical jambs. The second door is rigidly secured relatively to the door frame, and the first door is mounted within the door frame in such a manner that the first door glides relative to the door frame and relative to the second door. One application of the present invention is to selectively latch a leading member 96 on the first door 91 relative to the frame member or vertical jamb 95 of the door frame to prevent gliding of the first door relative to the frame (i.e. to lock the door).

The latch assembly 100 of the present invention generally includes a manual operator 200, a key operator 300, a latch portion 400, and a keeper portion 500. As shown in FIG. 2, the latch portion 400 is mounted to the leading member 96 on the first door 91, and the keeper portion 500 is mounted to the vertical jamb 95. The latch portion 400 cooperates with the keeper portion 500 to selectively latch the first door relative to the frame in a manner described in detail below. The manual operator 200 is secured to the inwardly facing side of the leading member 96 and is operatively connected to the latch portion 400 in such a manner that operation of the manual operator is linked to latching and unlatching of the latch portion 400 relative to the keeper portion 500. The key operator 300 is secured to the outwardly facing side of the leading member 96 and is operatively connected to the latch portion and to the manual operator 200 in such a manner that operation of the key operator is linked to latching and unlatching of the latch portion 400 relative to the keeper portion 500, and is also linked to operation of the manual operator.

Figure 3:
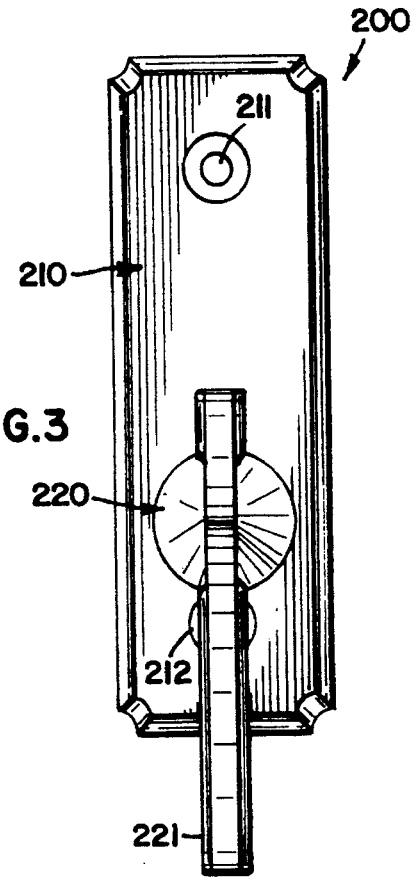
FIG. 3 is a front view of a manual operator that is a component of the latch assembly shown in FIG. 2 (as viewed from inside the gliding door unit shown in FIG. 1)
Figure 4:
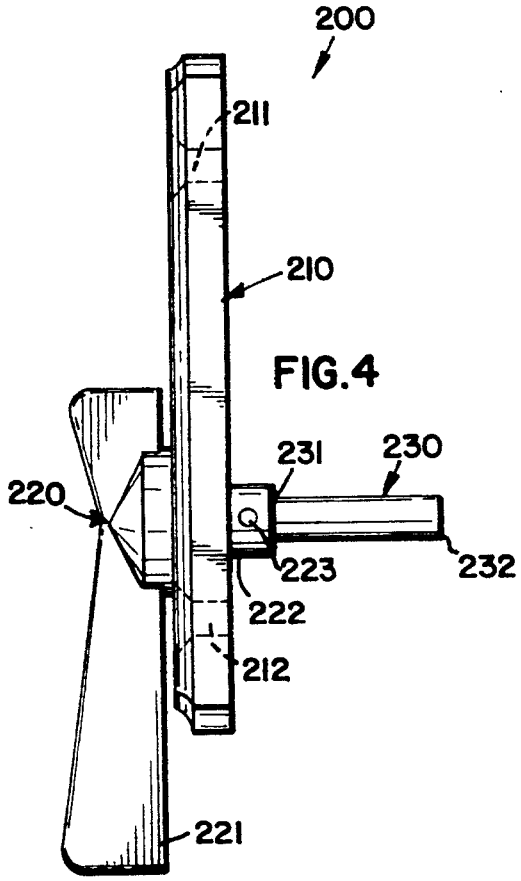
FIG. 4 is a side view of the manual operator shown in FIG. 3.

As shown in FIGS. 3–4, the manual operator 200 includes a mounting plate 210 to which a handle 220 is rotatably mounted. The rotatably mounting arrangement includes detents (not shown) which cause the handle 220 to snap into and out of fully locked and unlocked orientations. Countersunk holes 211 and 212 are formed through the mounting plate 210 to facilitate mounting of the mounting plate 210 to the leading member 96 by means of screws 201 and 202. The handle 220 includes a lever arm 221 that is long enough to be grasped in the palm of a person's hand, not just between thumb and forefinger. Accordingly, the handle 220 may be more easily manipulated by persons who might otherwise have difficulty, such as sufferers of arthritis. A shaft 222 extends from the handle 220 and through a hole in the mounting plate 210. The distal portion of the shaft 222 is split, and a hole is formed through the distal portion, transverse to the split.

A bar 230 extends from a first, pivoting end 231 to a second, distal end 232, and a hole is formed through the first end 231. The bar 230 has a substantially uniform, rectangular cross-section. The first end 231 extends into the split portion of the shaft, and a pin 223 extends through the hole in the shaft 222 and through the hole in the bar 230 to rotatably mount the bar relative to the shaft. The pin 223 extends in a direction substantially perpendicular to the lever arm 221, and the bar 230 extends substantially perpendicular away from the mounting plate 220 when in an operative position. Thus, the handle 220 and the bar 230 rotate together about an axis perpendicular to the mounting plate 210.

Figure 8:
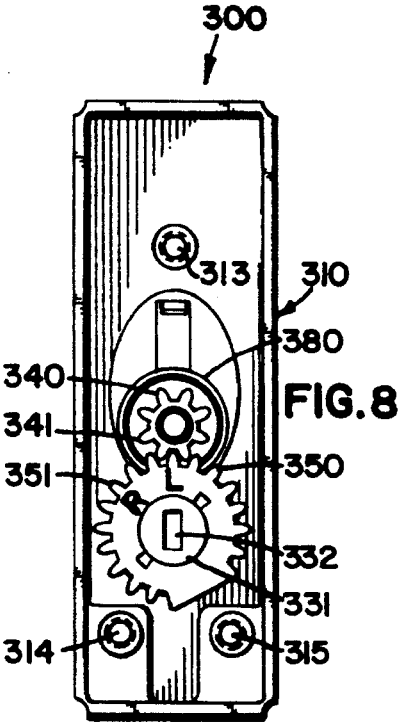
FIG. 8 is a rear view of the key operator shown in FIG. 5, with a back plate removed to reveal internal components of the key operator.

As shown in FIGS. 5–8, the key operator 300 includes a cylinder housing 310 to which a back plate 320 is mounted by means of screws extending through holes 323–325 and 313–315, respectively. A lock cylinder 380 is mounted within an outwardly protruding shoulder 318 of the housing 310. A mating key 390 may be inserted into the cylinder 380 and rotated relative thereto in order to latch or unlatch the latch assembly 100. As shown in FIG. 8, the cylinder 380 drives a relatively smaller gear 340 having gear teeth 341, which mate with gear teeth 351 on a relatively larger gear 350. The gears 340 and 350 are configured to provide a mechanical advantage for a person turning the key 390. Accordingly, the key 390 may be more easily turned by persons who might otherwise have difficulty.

A linking means 330 is rotatably mounted relative to the housing 310 and extends rearward through a hole in the back plate 320. The linking means includes a tube 331 having an open end rotatably mounted on a post extending rearward within the housing 310, and an opposite, closed end through which a rectangular slot 332 is formed. The relatively larger gear 350 is mounted on the tube 331 in such a manner that the two parts rotate relative to one another through a range of approximately 135 degrees, beyond which range the two parts rotate together. The relative sizes of the leading member 96, the bar 230, and the linking means 330 are such that the distal end 232 of the bar inserts into the slot 332 in the tube 331 when the manual operator 200 and the key operator 300 abut their respective sides of the leading member. Threaded holes 321 and 322 are formed through the back plate 320 to receive the screws 201 and 202 that pass through the countersunk holes 211 and 212 in the mounting plate 210. In this manner, the manual operator 200 and the key operator 300 are secured relative to one another with the leading member 96 disposed therebetween, and with the bar 230 and the tube 331 and hence, the handle 220 and the key 390, rotatably linked to one another.

As shown in FIG. 8, designations "R" and "L" are disposed on the larger gear 350 to facilitate orientation of the larger gear 350 relative to the smaller gear 340 for purposes of setting the latch assembly 100 for right hand or left hand operation. When the "L" is directly beneath the smaller gear 340, and the rectangular slot 332 is vertically aligned, the key operator is configured for left hand operation. On the other hand, when the "R" is directly beneath the smaller gear 340, and the rectangular slot 332 is vertically aligned, the key operator 300 is configured for right hand operation. The 135 degrees of "play" between the larger gear 350 relative and the tube 331 allows the larger gear 350 to be rotated between the "R" and "L" orientations while maintaining the vertical orientation of the rectangular slot 332.

Figure 9:
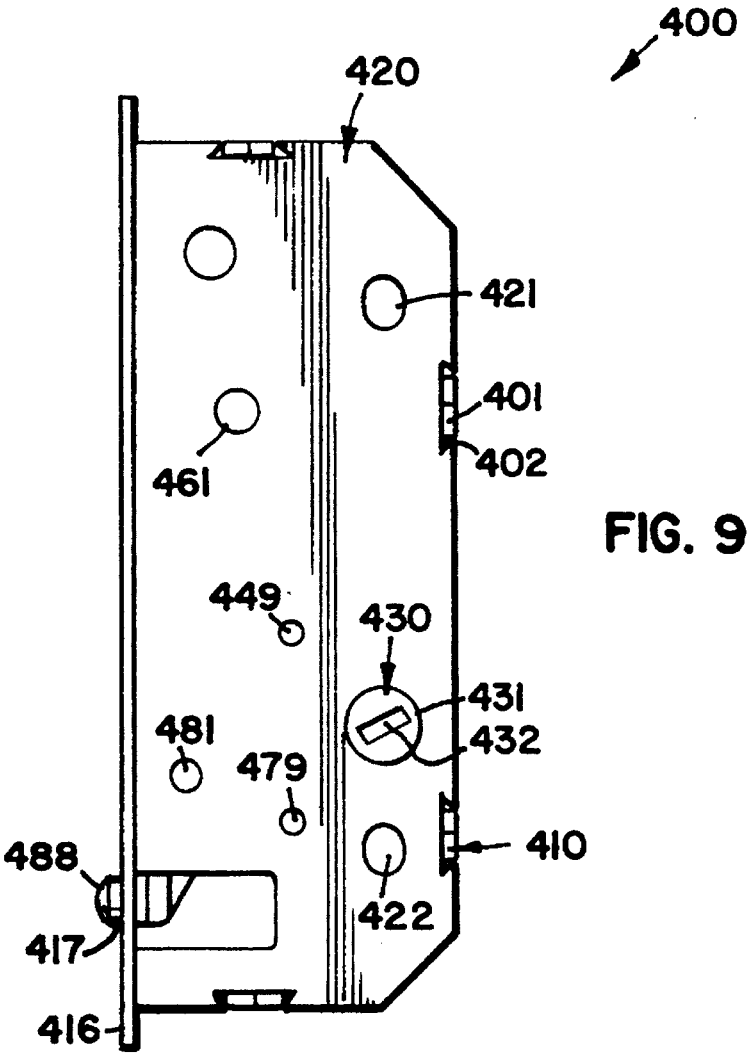
FIG. 9 is a side view of a door mounted, latch portion of the latch assembly shown in FIG. 2 (as viewed from outside the gliding door unit shown in FIG. 1)
Figure 13:
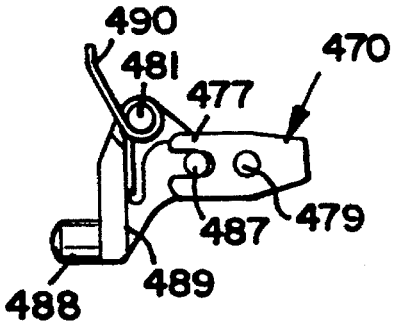
FIG. 13 is a side view of a mechanical sensor that is a component of the latch portion shown in FIG. 9 (as viewed from outside the gliding door unit shown in FIG. 1)

As shown in FIG. 9, the latch portion 400 includes a latch housing of a size and shape suitable to be nested within the leading member 96 of the door 91. The latch housing is formed by a box-like shell 410 and a side plate 420. Dog-eared flanges 401 on the shell 410 snap into engagement with recesses 402 along the edges of the side plate 420 to secure the side plate to the shell. The shell 410 includes a shell plate 404 that is substantially a mirror image of the side plate 420, with one significant exception that is discussed in detail below. A face plate 416 is secured to the latch housing and lies flush against the surface of the leading member 96 that faces toward the vertical jamb 95 when the latch housing 400 is nested within the leading member 96.

Holes 411 and 412 are formed through the shell plate 404, and corresponding holes 421 and 422 are formed through the side plate 420 to allow passage of the screws 201 and 202 that connect the manual operator 200 to the key operator 300. Other corresponding holes are formed through the shell plate 404 and the side plate 420 to receive bosses 431 that extend axially from a crank gear 430. In this manner, the crank gear 430 is rotatably mounted between the shell plate 404 and the side plate 420. A rectangular keyway 432 is formed axially through the crank gear 430. The keyway 432 is configured to allow passage of and mate with the bar 230 that extends from the manual operator 200 to the key operator 300. Accordingly, the handle 220, the crank gear 430, and the key 390 are constrained to rotate together in the same direction. In this regard, both the manual operator 200 and the key operator 300 provide means for rotating the crank gear 430 and hence, for operating the latch assembly 100.

With reference to FIG. 9 and 14–17, the crank gear 430 includes a series of gear teeth 433 that extend approximately halfway around the crank gear. The gear teeth 433 mate with a first series of gear teeth 443 on a linking gear 440, thereby constraining the crank gear 430 and the linking gear 440 to rotate together in opposite directions relative to one another. Additional corresponding holes are formed through the shell plate 404 and the side plate 420, to receive the ends of a shaft 449 on which the linking gear 440 is rotatably mounted. A second series of gear teeth 446 on the linking gear 440 mate with a series of gear teeth 466 on a latch gear 460, thereby constraining the linking gear 440 and the latch gear 460 to rotate together in opposite directions relative to one another, and constraining the latch gear 460 and the crank gear 430 to rotate together in the same direction. Yet another pair of corresponding holes, one formed through the shell plate 404, and the other through the side plate 420, receive bosses 461 that extend axially from the latch gear 460 to rotatably mount the latch gear between the shell plate 404 and the side plate 420. The gear linkage from the crank gear 430 to the latch gear 460 provides a mechanical advantage between rotation of the handle 220 or the key 390 and rotation of the latch gear.

Figure 12:
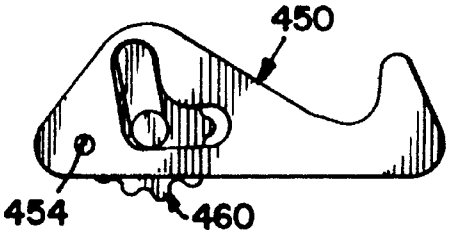
FIG. 12 is an side view of the latch shown in FIG. 10 engaged with the latch gear shown in FIG. 11 (as veiwed from inside the gliding door unit shown in FIG. 1) between "11" and ";".
Figure 11:
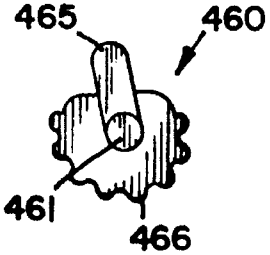
FIG. 11 is an side view of a latch gear that is a component of the latch portion shown in FIG. 9 (as viewed from inside the gliding door unit shown in FIG. 1)
Figure 10:
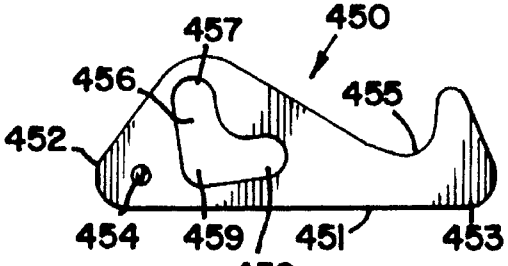
FIG. 10 is an side view of a latch that is a component of the latch portion shown in FIG. 9 (as viewed from inside the gliding door unit shown in FIG. 1)

As shown in FIG. 11, the series of gear teeth 466 extends approximately halfway around the latch gear 460. Opposite the series of gear teeth 466 is a nub 465 that extends radially away from the latch gear 460 and axially beyond the gear teeth. Together with the boss 461, the nub 465 is sized and configured to nest within an L-shaped slot 456 formed in a latch 450. As shown in FIG. 10, the latch 450 includes a relatively elongate body 451 that extends between a first end 452 and a second end 453. A peg 454 extends transversely from the body 451 proximate the first end 452, and the second end 453 is formed into a hook-like engaging member having a nook 455. The L-shaped slot 456 is formed through the body 451 in such a manner that a first segment having a remote end 457 extends substantially perpendicular to the length of the body 451, and a second segment having a remote end 458 extends substantially parallel to the length of the body 451. The two segments share a common corner 459 proximate the peg 454. FIG. 12 shows the nub 465 of the latch gear 460 in working relation to the L-shaped slot 456 in the latch 450.

As shown in FIGS. 14–21, the peg 454 on the latch 450 projects into a groove 405 formed in the shell plate 404. The groove 405 is configured to have (1) a first, arcuate portion centered about the latch gear bosses 461 and extending through approximately 80 degrees, from a first end 407 on the door side of the latch gear bosses to a second, remote end 406 not quite directly above the latch gear bosses; and (2) a second, linear portion having a first end 407 in common with the first end of the arcuate portion and extending horizontally away from said vertical jamb 95 to a second, remote end 408. The relative configurations of the latch 450, the latch gear 460, and the groove 405 cooperate to define an eccentric moving means for moving the latch 450 among the positions shown in FIGS. 14–17 in response to rotation of the drive gear 430 and the linking gear 440.

Figure 18:
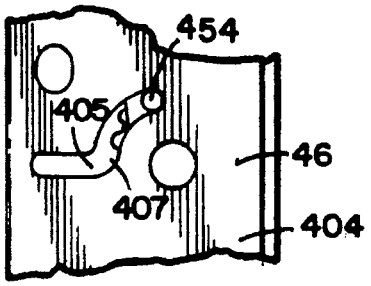
FIG. 18 is an opposite side view of part of the latch portion shown in FIG. 14 (as viewed from inside the gliding door unit shown in FIG. 1)
Figure 14:
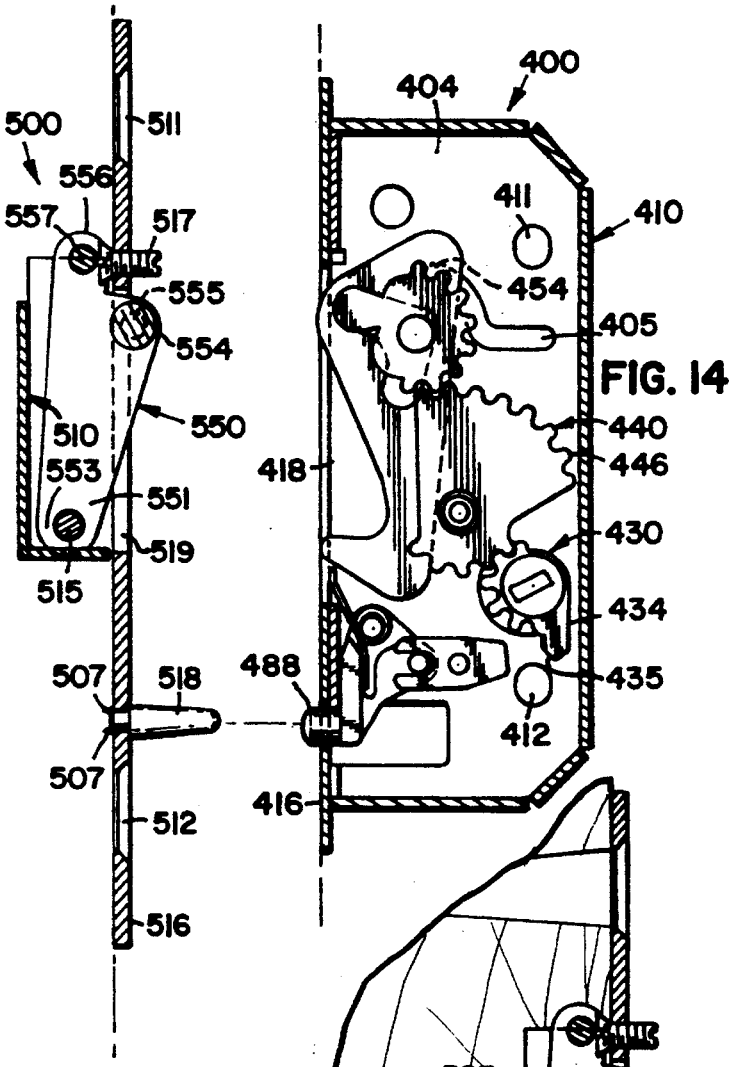
FIG. 14 is a sectioned side view of the latch assembly shown in FIG. 2, with a latch portion of the latch assembly in a first position (as viewed from outside the gliding door unit shown in FIG. 1)

FIG. 14 shows the latch 450 in a first, unlatched position, wherein the latch 450 is substantially within the latch housing. In this first position, the latch peg 454 is proximate the remote end 406 of the arcuate portion of the groove 405, as shown in FIG. 18; the latch gear nub 465 occupies the segment of the L-shaped slot 456 having the remote end 457, as shown in FIG. 14; and the nub 465 extends substantially toward the vertical jamb 95, as shown in FIG. 14.

Figure 19:
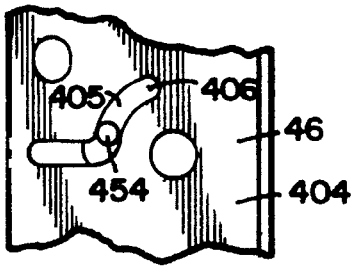
FIG. 19 is an opposite side view of part of the latch portion shown in FIG. 15 (as viewed from inside the gliding door unit shown in FIG. 1)
Figure 15:
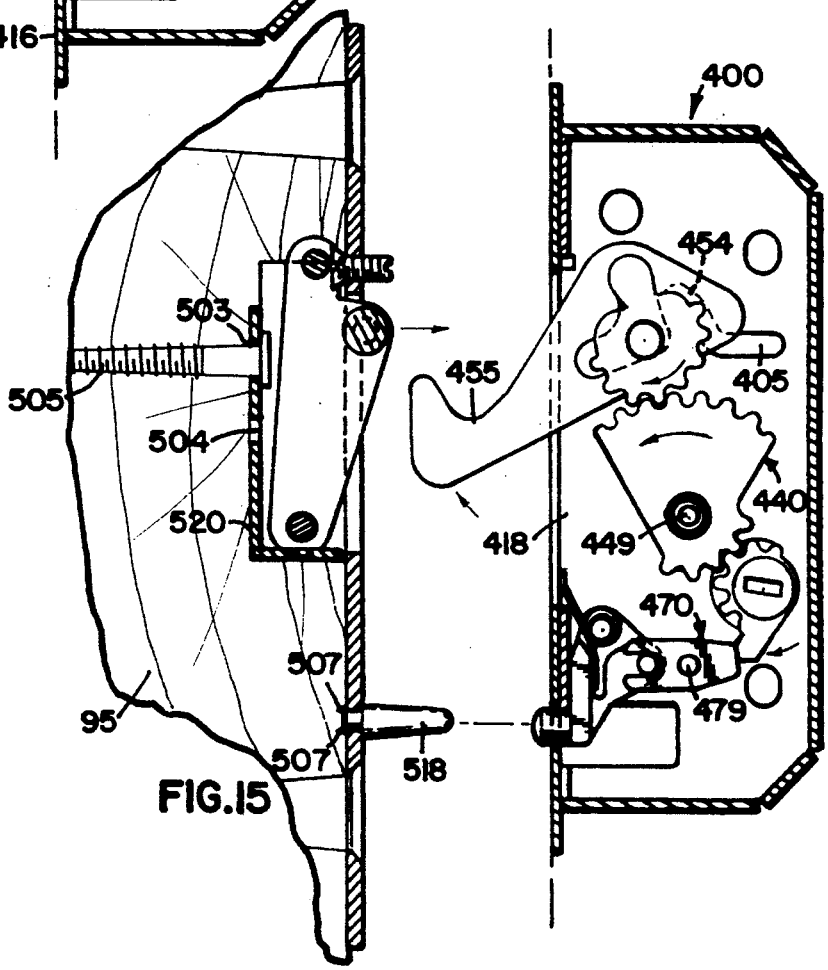
FIG. 15 is a sectioned side view of the latch assembly shown in FIG. 14, with the latch portion in a second position.

Rotation of the crank gear 430 in a clockwise direction (as viewed from the outside or key side of the door 91) causes counter-clockwise rotation of the linking gear 440, which in turn, causes clockwise rotation of the latch gear 460, as indicated by arrows in FIG. 15. The latch gear nub 465 continues to occupy the segment of the L-shaped slot 456 having the remote end 457, as shown in FIG. 15, and thus, the latch 450 and the latch gear rotate together as the latch peg 454 travels down the arcuate portion of the groove 405, as shown in FIG. 19. An opening 418 is formed through the face plate 416 to allow the latch 450 to project outside the housing and into a second, outreaching position, as shown in FIG. 15.

The crank gear 430 further includes a finger 434 that extends substantially radially away from the bosses 431, substantially perpendicular to the rectangular keyway 432, and substantially downward when the series of gear teeth 433 is facing substantially toward the jamb 95, as shown in FIG. 14. The finger 434 provides a leading surface 435 as the crank gear rotates in a clockwise direction to latch the latch assembly 100. As shown in FIG. 15, clockwise rotation of the crank gear 430 is limited by a bar 470 that obstructs the rotational path of the crank gear finger 434. In particular, the leading surface 435 on the finger 434 engages an edge 475 on a first end of the bar 470.

The bar 470 is rotatably mounted on a shaft 479 that extends between corresponding holes in the shell plate 404 and the side plate 420. A second, opposite end 477 of the bar 470 is notched to receive a pin 487 extending transverse to the notch. The pin 487 is part of a lever 480 having bosses 481 that extend axially from lever 480 and project into other corresponding holes formed through the shell plate 404 and the side plate 420 to rotatably mount the lever between the shell plate and the side plate. The lever 480 includes a button 488 that projects into a second, relatively smaller opening 417 in the face plate 416. A torsional spring 490 is mounted on one of the bosses 481 and operatively connected between the lever 480 and the rear of the face plate 416 to bias the lever 480 in a clockwise direction so that the button 488 is biased into the button opening 417. When the lever 480 occupies this spring biased position shown in FIGS. 14–15, the bar 470 occupies a substantially horizontal position and the edge 475 is positioned to engage the leading surface 435 on the crank gear finger 434 as the crank gear 430 rotates clockwise.

Figure 16:
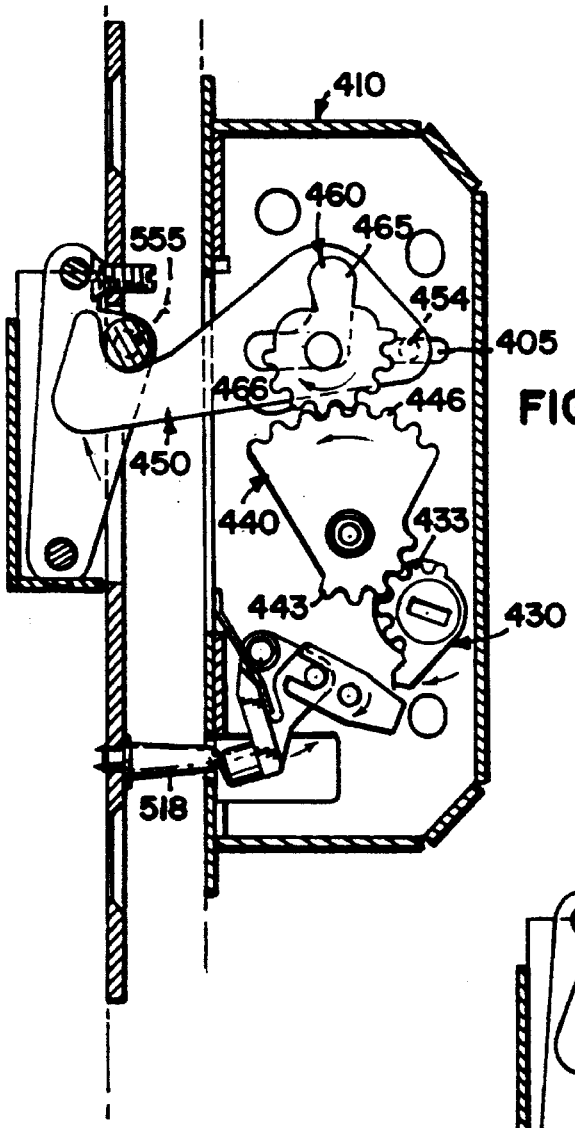
FIG. 16 is a sectioned side view of the latch assembly shown in FIG. 14, with the latch portion in a third position.

The relative positions of the bosses 481, the pin 487, and the button 488 are such that deflection of the button 488 toward the latch housing cause counter-clockwise rotation of the lever 488, which in turn, causes clockwise rotation of the bar 470, as shown by the arrows in FIG. 16. A strike plate 516 is secured flush against the surface of the vertical jamb 95 facing toward the leading member 96 on the door 91, and a spike 518 extends from the strike plate 516 and toward the face plate 416 that forms a part of the latch housing 400 to provide a means for deflecting the button 488 as the leading member 96 approaches the vertical jamb 95. The strike plate 516 faces toward and is substantially parallel to the face plate 416. The spike 518 is slideably mounted within a lateral slot 508 in the strike plate 516 to allow lateral adjustment of the spike prior to tightening of screws 501 and 502 that secure the strike plate to the vertical jamb 95. When the spike 518 is satisfactorily aligned relative to the opening 417 and the button 488, the screws are tightened, and nubs or cleats 507 dig into the jamb 95 to secure the spike 518 against further lateral movement.

An opening 519 in the strike plate 516, as well as the opening 418 in the face plate 416, allows the latch 450 to access the keeper rod 555. As the spike 488 pushes the button 488 into the latch housing 410, the button lever 480 rotates the bar 470 clockwise to an orientation wherein the edge 475 no longer obstructs the rotational path of the crank gear finger 434, thereby freeing the crank gear 430 to rotate clockwise beyond the orientation shown in FIG. 15. In this regard, the button lever 480 and the parts associated therewith function as a means for sensing if and when the leading member 96 is within a desired distance from the jamb 95 and limiting operation of the latch accordingly.

Figure 20:
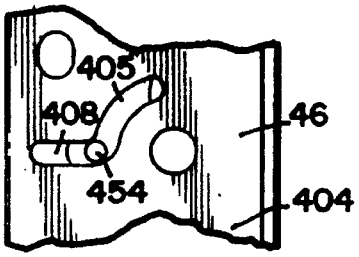
FIG. 20 is an opposite side view of part of the latch portion shown in FIG. 16 (as viewed from inside the gliding door unit shown in FIG. 1)
Figure 21:
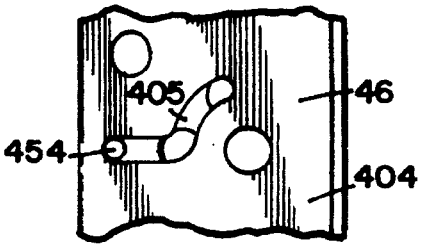
FIG. 21 is an opposite side view of part of the latch portion shown in FIG. 17 (as viewed from inside the gliding door unit shown in FIG. 1.

Continued clockwise rotation of the crank gear 430 causes continued counter-clockwise rotation of the linking gear 440, which in turn, causes continued clockwise rotation of the latch gear 460, as indicated by arrows in FIG. 16. The latch gear nub 465 continues to occupy the segment of the L-shaped slot 456 having the remote end 457, as shown in FIG. 16, and thus, the latch 450 and the latch gear continue to rotate together as the latch peg 454 travels down the remainder of the arcuate portion of the groove 405 and into the linear portion of the groove 405, as shown in FIG. 20. The latch projects further outward and relatively more upward through the opening 418 and into the opening 519 to occupy a third, keeper engaging position, as shown in FIG. 16. In this third position, the nook 455 on the hook-like end 453 of the latch 450 engages a keeper rod 555 secured relative to the vertical jamb 95.

The keeper rod 555 is part of the keeper portion 500, which includes a box-like keeper housing 510 of a size and shape suitable to be nested within the vertical jamb 95 behind the strike plate 516. A pair of slots 511 and 512 are formed through the strike plate 516 to facilitate mounting of the strike plate to the jamb 95 by means of screws 501 and 502, as shown in FIG. 2. The slots 511 and 512 provide an element of adjustability for mounting the keeper portion 500 at a suitable height relative to the latch portion 400, so that the latch 450 and keeper rod 555 and the spike 518 and button 488 are relatively aligned. An additional pair of holes 503 and 504 are formed through a rear wall 520 of the keeper housing 510 to receive an additional, security screw 505 that is three inches long. Two holes are provided in case a minor vertical adjustment of the keeper housing 510 is required after a hole has already been formed into the jamb 95 to align with one of the holes 503 and 504.

Figure 22:
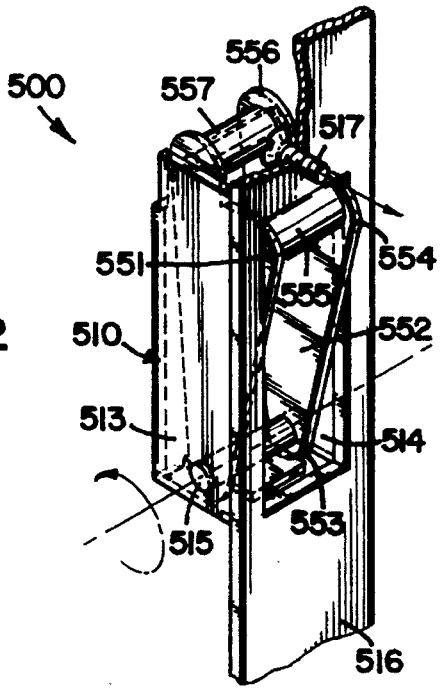
FIG. 22 is a perspective view of a keeper portion of the latch assembly shown in FIG. 2.

As shown in FIG. 22, the keeper housing 510 includes a pair of parallel sidewalls 513 and 514 that extend into a recess in the jamb 95. A shaft 515 extends between the sidewalls 513 and 514, and a keeper lever 550 is rotatably mounted thereto. The keeper lever 550 has a pair of parallel sidewalls 551 and 552 that extend from respective lower ends 553, rotatably mounted to the shaft 515, to respective upper ends 556, between which a support rod 557 is secured. The upper ends 556 extend upward beyond the housing 510 and behind the strike plate 516. A screw 517 is threaded into a hole in the strike plate 516 in such a manner that the head of the screw lies within the rotational path of the support rod 557.

The sidewalls 551 and 552 also include shoulder portions 554 that extend toward the face plate 416 and project out the opening 519 just beneath the upper confines of the housing 510. The keeper rod 555 is secured between the shoulder portions 554 to provide a catch for the latch 450 and thereby facilitate latching of the assembly 100. The geometry of the keeper lever 550 is such that lines drawn between the keeper rod 555, the support rod 557, and the shaft 515 form a scalene triangle. The screw 517 limits the extent to which the keeper rod 555 may pivot out beyond the strike plate 516 and thus, provides a means for adjusting the proximity of the face plate 416 and the strike plate 516 when the assembly 100 is latched, or in other words, a means for adjusting the extent to which weather stripping 509 is compressed between the leading member 96 and the vertical jamb 95.

Figure 17:
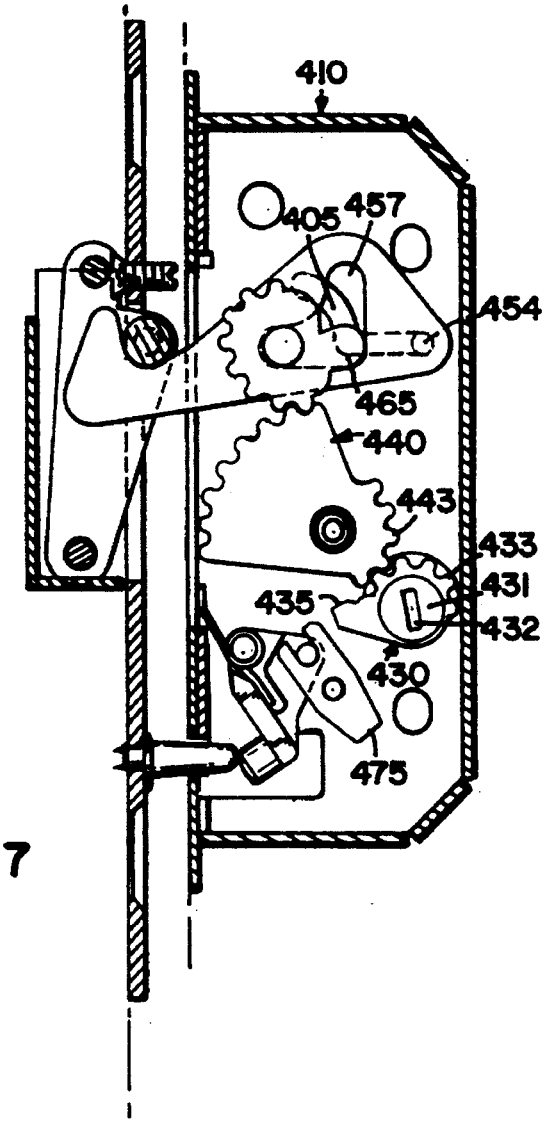
FIG. 17 is a sectioned side view of the latch assembly shown in FIG. 14, with the latch portion in a fourth position.

As the nook 455 engages the keeper rod 555, as shown in FIG. 16, the peg 454 encounters the linear portion of the groove 405, as shown in FIG. 20. Thus, the latch can no longer rotate clockwise together with the latch gear 460. Rather, continued clockwise rotation of the latch gear 460 causes the latch gear nub 465 to travel down from the remote end 457 of L-shaped slot 456 and into the corner 459 of the L-shaped slot, as the bosses 461 travel toward the other remote end 458 of the L-shaped slot. The motion of the latch gear 460 relative to the L-shaped slot 456 causes the peg 454 to travel along the linear portion of the groove 405, away from the keeper portion 500, to the position shown in FIG. 21. As a result, the latch 450 pulls the latch portion 400 toward the keeper portion 500 to arrive at a fourth, latched position, as shown in FIG. 17. In this latched position, weather stripping 509 is effectively compressed between the leading member 96 and the jamb 95.

Rotation of the crank gear 430 in an opposite, counter-clockwise direction (as viewed from the outside or key side of the door 91) causes clockwise rotation of the linking gear 440, which in turn, causes counter-clockwise rotation of the latch gear 460 to drive the latch 450 and the other parts back to their unlatched position shown in FIG. 14. Since the assembly 100 must be unlatched before the door 91 can be opened, the crank gear finger 434 returns to its position shown in FIG. 14 before the button 488 is released, and thus, before the bar 470 returns its position shown in FIG. 14.

The present invention has been described with reference to specific embodiments, methods, and applications. However, those skilled in the art will recognize additional embodiments, methods, and applications that fall within the scope of the present invention. For example, the present invention is applicable to gliding door units having more than one gliding door. Moreover, the present invention is applicable to other types of gliding panel assemblies, including gliding window units, for example. Also, the latch portion of the present invention could be secured to the vertical jamb, and the keeper portion could be secured to the gliding door. Accordingly, the present invention is to be limited only by the appended claims.

What is claimed is:

1. A lock for a gliding door unit of a type having at least one operating panel that is horizontally moveable relative to a vertical receiving jamb, the lock comprising:

a reach out latch portion configured for mounting to the operating panel, wherein said reach out latch portion includes:

a housing; and a latch operatively connected to said housing and having a hook-like engaging member that is moveable between an unlatched position substantially within said housing, a keeper engaging position at a first distance outside said housing, and a latched position at a second, relatively lesser distance outside said housing;

a keeper portion configured for mounting to the receiving jamb, said keeper portion having a keeper configured to be selectively engaged by said hook-like engaging member; and a moving means for moving said latch from said unlatched position to said keeper engaging position to said latched position, wherein in a first phase of operation, said moving means rotates said latch from said unlatched position to said keeper engaging position, and in a second phase of operation, said moving means moves said latch linearly from said keeper engaging position to said latched position and causes said latch portion to move toward said keeper portion, thereby causing the operating panel to move toward the receiving jamb, wherein said moving means includes a slot in said housing, and a peg on said latch protrudes through said slot, and said slot includes an arcuate portion through which said peg travels in said first phase of operation, and linear portion through which said peg travels in said second phase of operation.

2. A lock according to claim 1, wherein said latch portion further comprises a controlling means for controlling movement of said hook-like engaging member between said keeper engaging position and said latched position, said controlling means being moveable from a first position, wherein said controlling means prevents movement of said hook-like engaging member from said keeper engaging position to said latched position, to a second position, wherein said controlling means allows movement of said hook-like engaging member from said keeper engaging position to said latched position.

3. A lock for a gliding door unit of a type having at least one operating panel that is horizontally moveable relative to a vertical receiving jamb, the lock comprising:

a reach out latch portion configured for mounting to the operating panel, wherein said reach out latch portion includes:

a housing; and a latch operatively connected to said housing and having a hook-like engaging member that is moveable between an unlatched position substantially within said housing, a keeper engaging position at a first distance outside said housing, and a latched position at a second, relatively lesser distance outside said housing;

a keeper portion configured for mounting to the receiving jamb, said keeper portion having a keeper configured to be selectively engaged by said hook-like engaging member, said keeper portion further comprising:

a strike plate having an opening formed therein and having an outer side and an inner side;

a keeper housing connected to said inner side proximate said opening, wherein said keeper is connected to said housing proximate said opening; and side members pivotally mounted to said keeper housing and positioned substantially within said keeper housing, and said keeper extends transversely between said side members; and an eccentric moving means for moving said latch from said unlatched position to said keeper engaging position to said latched position, wherein movement of said latch from said keeper engaging position to said latched position is generally horizontal and causes said latch portion to move toward said keeper portion, thereby causing the operating panel to move toward the receiving jamb.

4. A lock according to claim 3, wherein said keeper is pivotally mounted to said keeper housing.

5. A lock according to claim 3, wherein portions of said side members extend behind said strike plate above said opening to resist excessive pivoting of said side members.

6. A lock according to claim 5, wherein said keeper portion further comprises a screw threadably mounted to said strike plate above said opening, wherein said screw engages said keeper and thereby limits pivoting of said side members, and rotation of said screw relative to said strike plate sets a pivoting limit.

7. A lock for a gliding door unit of a type having at least one operating panel that is horizontally moveable relative to a vertical receiving lamb, the lock comprising:

a reach out latch portion configured for mounting to the operating panel, wherein said reach out latch portion includes:

a housing; and a latch operatively connected to said housing and having a hook-like enqaging member that is moveable between an unlatched position substantially within said housing, a keeper engaging position at a first distance outside said housing, and a latched position at a second, relatively lesser distance outside said housing;

a keeper portion configured for mounting to the receiving jamb, said keeper portion having a keeper configured to be selectively engaged by said hook-like engaging member; and an eccentric moving means for moving said latch from said unlatched position to said keeper engaging position to said latched position, wherein movement of said latch from said keeper engaging position to said latched position is generally horizontal and causes said latch portion to move toward said keeper portion, thereby causing the operating panel to move toward the receiving jamb, said moving means comprising:

an operating means for operating the lock;

a first gear linked to rotate together with said operating means; and a second gear linked to rotate in response to rotation of said first gear, wherein a nub projects from said second gear into an L-shaped slot in said latch, and rotation of said first gear in a first direction causes said latch to move from said unlatched position to said keeper engaging position to said latched position.

8. A lock according to claim 7, further comprising a mechanical sensing means operatively connected to said first gear for limiting rotation of said first gear in said first direction when the operating panel is spaced apart from the receiver jamb.

9. A lock according to claim 8, further comprising a spike extending from the receiver jamb toward the operating panel, wherein when the operating panel is proximate the receiver jamb, said spike enters said housing and thereby causes said mechanical sensing means to release said first gear for rotation in said first direction and also provides resistance to vertical movement of the operating panel relative to the receiver jamb.

10. A gliding panel unit, comprising:

a frame including a pair of parallel vertical jambs, a horizontal sill jamb extending between lower ends of said vertical jambs, and a horizontal head jamb extending between upper ends of said vertical jambs;

at least one panel movably mounted within said frame in such a manner that said panel glides horizontally between said vertical jambs;

a keeper secured relative to one of said vertical jambs;

a latch secured relative to a side of said panel proximate said one of said vertical jambs in such a manner that said latch is proximate said keeper when said side of said panel is proximate said one of said vertical jambs, and said latch is selectively moveable between an unlatched position and a discrete latched position, wherein in said latched position, said latch engages said keeper to prevent movement of said panel away from said one of said vertical jambs;

a face plate secured relative to said side of said panel and facing toward said one of said vertical jambs, and a hole formed through said face plate;

a button movably secured relative to said side of said panel and accessible via said hole, wherein said button is operatively connected to said latch in such a manner that when said button occupies a first position, said latch is barred against movement to said latched position, and when said button occupies a second position, said latch is free to move to said latched position; and a spike secured relative to said one of said vertical jambs, aligned with said hole, and extending toward said face plate, wherein said spike enters said hole when said side of said panel is proximate said one of said vertical jambs, moving said button from said first position to said second position and also providing resistance to vertical movement of said panel relative to said one of said vertical jambs.

11. A gliding panel unit, comprising:

a frame including a pair of parallel vertical jambs, a horizontal sill jamb extending between lower ends of said vertical jambs, and a horizontal head jamb extending between upper ends of said vertical jambs;

at least one panel movably mounted within said frame in such a manner that said panel glides horizontally between said vertical jambs;

a keeper secured relative to one of said vertical jambs;

a latch secured relative to a side of said panel proximate said one of said vertical jambs in such a manner that said latch is proximate said keeper when said side of said panel is proximate said one of said vertical jambs, and said latch is selectively moveable between an unlatched position and a discrete latched position, wherein in said latched position, said latch engages said keeper to prevent movement of said panel away from said one of said vertical jambs;

a face plate secured relative to said side of said panel and facing toward said one of said vertical jambs, and a hole formed through said face plate;

a strike plate secured to said one of said vertical jambs and facing toward said face plate, wherein said keeper is secured relative to said one of said vertical jambs on a side of said strike plate opposite said face plate, and said latch accesses said keeper by projecting through an opening through said face plate and another opening through said strike plate;

a button movably secured relative to said side of said panel and accessible via said hole, wherein said button is operatively connected to said latch in such a manner that said button must be deflected away from said one of said vertical jambs before said latch can be moved to said latched position; and a spike secured relative to said one of said vertical jambs, aligned with said hole, and extending toward said face plate, wherein said spike enters said hole when said side of said panel is proximate said one of said vertical jambs, thereby deflecting said button away from said one of said vertical jambs and also providing resistance to vertical movement of said panel relative to said one of said vertical jambs.

12. A gliding panel unit according to claim 11, further comprising a pair of sidewalls extending from said strike plate into said one of said vertical jambs, and a keeper lever having a first end pivotally mounted between said pair of sidewalls, and an opposite, distal end extending behind said strike plate, wherein said keeper extends between said pair of sidewalls at a distance from a line segment extending between said first end and said distal end toward said face plate, wherein said line segment and lines drawn from each end of said line segment to said keeper form a scalene triangle.

13. A gliding panel unit according to claim 12, further comprising a screw threadably mounted to said strike plate above said another opening, wherein said screw has a head that engages said distal end as said keeper lever pivots about said first end, and rotation of said screw relative to said strike plate limits to what extent said keeper pivots toward said panel.

14. A gliding panel unit according to claim 10, wherein said latch is secured within a housing nested within said side of said panel, and said latch rotates in a plane substantially parallel to said panel, and an operator means is secured outside said panel and is operatively connected to said latch by a linkage that extends substantially perpendicular to said panel.

15. A gliding panel unit according to claim 10, further comprising a strike plate secured to said one of said vertical jambs and facing toward said face plate, wherein said spike is slideably mounted within a lateral slot in said strike plate to facilitate alignment of said spike relative to said hole.

16. A latch assembly of a type that secures a sliding member relative to a frame in which the sliding member slides, comprising:

a latch portion secured to the sliding member, said latch portion including:

a plate having a hole and a groove formed therein, said groove having an arcuate portion centered about said hole, and a linear portion extending from an end of said arcuate portion away from said hole;

a latch extending lengthwise between a keeper engaging end and an opposite end and having an L-shaped slot formed therein, wherein a first segment of said L-shaped slot extends substantially lengthwise, and a second segment of said L-shaped slot extends substantially perpendicular to said first segment, and said latch is moveable in a plane substantially parallel to said plate from an unlatched position to a keeper engaging position to a latched position, and a peg projects from said opposite end into said groove in a direction substantially perpendicular to said plane; and a latch gear having a boss that inserts through said L-shaped slot and into said hole to rotatably mount said latch gear relative to said plate, wherein a nub extends radially from said boss, and said nub occupies said second segment of said L-shaped slot and extends away from said hole substantially diametrically across from said linear portion of said groove when said latch is in said unlatched position, and said nub occupies said second segment of said L-shaped slot and extends away from said hole substantially perpendicularly to said linear portion of said groove when said latch is in said keeper engaging position, and said boss occupies said first segment of said L-shaped slot, and said nub extends away from said hole in a direction substantially similar to said linear portion of said groove when said latch is in said latched position; and a keeper secured to a side of the frame facing toward the sliding member and configured to be engaged by said keeper engaging end of said latch.

17. A latch assembly according to claim 16, further comprising a latch operator secured relative to said latch portion and operable to rotate a crank gear rotatably mounted relative to said plate, wherein rotation of said crank gear causes rotation of said latch gear.

18. A latch assembly according to claim 17, further comprising a linking gear rotatably mounted relative to said plate and interconnecting said crank gear and said latch gear in a manner that provides a mechanical advantage for rotating said latch gear in response to rotation of said crank gear.

19. A latch assembly according to claim 16, further comprising:

a sensing means operatively connected to said plate for sensing if the sliding member is within a desired distance from the side of the frame; and a stopping means operatively connected to said sensing means for stopping said latch from moving to said keeper engaging position if the sliding member is beyond said desired distance from the side of the frame.

20. A latch assembly according to claim 19, wherein said sensing means includes a spike extending from the side of the frame toward the sliding member, and a button on the latch portion that is contacted by said spike when the sliding member moves within said desired distance from the side of the frame.

21. A lock according to claim 7, wherein said moving means includes a rotating member connected to said latch in such a manner that rotation of said rotating member through a first range of rotation, corresponding with said first phase of operation, causes said latch to rotate together therewith, between said unlatched position and said keeper engaging position, and rotation of said rotating member through a second range of rotation, corresponding with said second phase of operation, causes said latch to travel linearly relative thereto, between said keeper engaging position and said latched position.

22. A gliding panel unit according to claim 10, further comprising an adjusting means for adjusting said spike relative to said one of said vertical jambs to facilitate alignment of said spike and said hole.

23. A lock for a gliding door unit of a type having at least one operating panel that is horizontally moveable relative to a vertical receiving jamb, the lock comprising:

a reach out latch portion configured for mounting to the operating panel, wherein said reach out latch portion includes:

a housing; and a latch operatively connected to said housing and having a hook-like engaging member that is moveable between an unlatched position substantially within said housing, a keeper engaging position at a first distance outside said housing, and a latched position at a second, relatively lesser distance outside said housing;

a keeper portion configured for mounting to the receiving jamb, said keeper portion having a keeper configured to be selectively engaged by said hook-like engaging member; and a moving means for moving said latch from said unlatched position to said keeper engaging position to said latched position, wherein in a first phase of operation, said moving means rotates said latch from said unlatched position to said keeper engaging position, and in a second phase of operation, said moving means moves said latch linearly from said keeper engaging position to said latched position and causes said latch portion to move toward said keeper portion, thereby causing the operating panel to move toward the receiving jamb, wherein said moving means includes a rotating member, and said rotating member and said latch rotate together about a common axis of rotation in said first phase of operation.

24. A lock according to claim 23, wherein said rotating member rotates relative to said latch in said second phase of operation.

25. A lock according to claim 7, wherein said moving means includes a rotating member having an eccentric portion which rests against said latch in said first phase of operation, and which slides against said latch in said second phase of operation.

* * * * *

UNITED STATES PATENT AND TRADEMARK OFFICE
CERTIFICATE OF CORRECTION

PATENT NO. : 5,595,409

DATED : Jan. 21, 1997

INVENTOR(S) : Fier et al.

It is certified that error appears in the above-identified patent and that said Letters Patent is hereby corrected as shown below:

On the title page, item

[73], Assignee, "Anderson" should read --Andersen--.

In column 3, line 21, "FIG. 10" should start a new paragraph; line 24, " FIG. 11" should start w paragraph; line 28, "veiwed" should read --viewed--; lines 29-30, delete "between 11" and ";" · " FIG. 1)".

In column 6, line 13, " FIG. 9" should read -- FIGS. 9--.

In column 10, claim 1, line 22, insert --a-- after the word "and".

In column 11, claim 7, line 17, "lamb" should read --jamb--.

In column 13, claim 15, line 40, insert --in a direction parallel to the strike plate, ›endicular to the spike-- after the word "hole".

Signed and Sealed this

Twenty-third Day of December, 1997

Bruce Lehman

*Attest:*

BRUCE LEHMAN

*Attesting Officer*

*Commissioner of Patents and Trademarks*